United States Patent [19]

Bryant et al.

[11] Patent Number: 4,846,597

[45] Date of Patent: Jul. 11, 1989

[54] LINE PRINTER PANEL AND CONTROL SYSTEM

[75] Inventors: David V. Bryant, Agoura Hills; David A. Neese, Newbury Park, both of Calif.

[73] Assignee: Advanced Matrix Technology, Inc., Camarillo, Calif.

[21] Appl. No.: 173,369

[22] Filed: Mar. 25, 1988

[51] Int. Cl.[4] ..... B41J 5/08

[52] U.S. Cl. ..... 400/472; 400/83; 341/23; 341/35

[58] Field of Search ..... 400/61, 76, 70, 472, 400/474, 83; 341/22, 23, 35

[56] References Cited

U.S. PATENT DOCUMENTS

| | | | |
|---|---|---|---|
| 2,297,743 | 10/1942 | Carroll et al. | 400/78 X |
| 4,044,242 | 9/1977 | Laesser | 341/35 X |
| 4,121,228 | 10/1978 | Cowe et al. | 400/472 X |
| 4,430,644 | 2/1984 | Blanchard, Jr. et al. | 400/479 X |
| 4,527,917 | 7/1985 | Ueno | 400/479 X |
| 4,555,193 | 11/1985 | Stone | 400/472 X |
| 4,633,227 | 12/1986 | Menn | 341/22 |
| 4,698,618 | 10/1987 | Luizzo et al. | 341/22 |

*Primary Examiner*—Edgar S. Burr
*Assistant Examiner*—James R. McDaniel
*Attorney, Agent, or Firm*—Merchant & Gould

[57] ABSTRACT

A system for controlling and displaying the printing format of dot matrix printers includes a microprocessor, a memory which is loaded with programs from replaceable software cards, and a control panel having a plurality of control buttons, an aligned display, and a rotary control coupled to the microprocessor. In a first mode, depression of a selected control button accesses the corresponding one of the parameters of the most commonly used print parameters and repeated actuation of the selected control button cycles through the options contained within the parameter, the parameter and current option being sequentially presented on the display. In a second mode under microprocessor control, each one of the parameters in a printing parameter menu is sequentially accessed and rotation of the rotary dial provides scrolling through each option contained within the parameter. Sets of selected parameter options can be saved under specified designations for later retrieval and use. The rotary control is also independently used to move paper and printhead to starting positions. Thus a great number of parameters, with a number of options for each parameter can be selectively set by an operator in an exceptionally easy to understand and use manner.

16 Claims, 4 Drawing Sheets

| OPERATIONS |
|---|
| 1) RSTOR:<br>2) SAVE:<br>3) DFALT:<br>4) TEST: |
| **PRINT MODES** |
| 5) EM:<br>6) QUAL:<br>7) FONT:<br>8) PITCH<br>9) CELL:<br>10) LPI:<br>11) COLOR:<br>12) ITALIC:<br>13) HIGH:<br>14) WIDE:<br>15) SCRIPT:<br>16) UNDLINE:<br>17) BLD/SHA:<br>18) CTR/JST:<br>19) LANG:<br>20) DIRCTN: |
| **PAGE SET UP** |
| 21) LENGTH:<br>22) WIDTH:<br>23) DEMAND:<br>24) BIN:<br>25) TOP MAR:<br>26) BOT MAR:<br>27) LFT MAR:<br>28) RGT MAR: |
| **TABS** |
| 29) SET HOR:<br>30) CLR HOR:<br>32) SET VER:<br>32) CLR VER: |
| **COMMUNICATIONS** |
| 33) INTRFCE:<br>34) BAUD:<br>35) PARITY:<br>36) DTA BITS:<br>37) STOP BITS:<br>38) HNDSHAK:<br>39) DTR:<br>40) STROBE:<br>41) BUSY +:<br>42) ACK −: |
| **SPECIAL MODES** |
| 43) HEX MODE:<br>44) DOWNLOAD:<br>45) AUTO CR:<br>46) AUTO LF:<br>47) AUTO FF:<br>48) IBM SET: |

FIG. 3

LINE PRINTER PANEL AND CONTROL SYSTEM

BACKGROUND OF THE INVENTION

This invention relates to dot matrix printer systems, and more particularly to control systems for facilitating operator selection of a wide variety of functions and operating modes in a serial character printer.

Modern dot matrix printers provide features and versatility that cannot readily be duplicated by other mechanical printer types, because the dot matrix format enables virtually arbitrary placement of dots to form characters, patterns, graphs and other representations. The most used form is the serial character printer, which can be manufactured at suitably low cost for usage with modern personal computers and microcomputers.

Such printers now commonly use the capability for almost arbitrary dot placement to provide many different print formats at different speeds. The individual character cell (originally formed by a typically 5×7 matrix) is now varied from a relatively low density matrix, used in draft mode printing, to a much higher density letter mode. Moreover, type fonts can be changed by using different software or ROMs, and different languages can be accommodated. Characters can be reduced or expanded in size and inter-cell spacings can also be manipulated. Special printing features, such as underlining, bold characters, subscripts and superscripts are also incorporated.

Easy control of margins, page setup and paper movement functions for both cut sheet and pinfeed paper are sought. There is much more to the modern printer system, however, since it generally incorporates its own central processor unit and is capable of quite complex functions. It is therefore quite common to provide a variety of communications options, as in responding to different bit rates, handshaking protocols, serial and parallel inputs and even emulating other machines. Printing in different colors is often a desirable feature. In addition, different users and different applications may require certain standard settings, and for these it should be unnecessary to proceed through an entire setup procedure. Instead, the chosen settings should be effective upon startup or with a simple selection procedure. Operation of these systems has therefore become increasingly complex as the number of features and control functions have increased. The usual design response has been to provide a wide variety of selection switches and devices, both on the control panel for the unit and within the unit itself.

An example of a modern serial character printer having multiple controls is provided by the AMT Office Printer, which has an array of pushbuttons for controlling individual mechanical and electronic functions. It includes internal DIP switches which must be accessed by opening the cover of the machine to control communication configurations, for example. While this system has gained wide acceptance and is at the level of the current state of the art, it is desirable to provide even more functions and controls. This would make the tasks of the printer system operator unduly complicated if the same control and display approach were to be utilized. Only a long instructional period would suffice to enable the operator to readily determine the options available, to set parameters and choose modes. Furthermore, it is difficult to organize a system such that more features can be added, or features can be revised, without inordinately increasing the cost of the electronics or the mechanical part of the system. The entire menu must be available for changing parameters but the most often used parameters should be readily changeable.

There are many techniques and systems available for providing multi-function controls. Remote control devices for video and audio equipment have particularly been designed for ease of operation and clarity of interaction. These typically have an array of buttons and function with a control system which concurrently provides a display of elements in a changing sequence or menu. One such panel control is the Casio Model HT-700 electronic keyboard synthesizer in which many pushbuttons are disposed in different positions for controlling different functions, and a rotary dial is used in one mode to control tempo and in another mode to control sequencing of numbers on a display in order that different control functions can be selected. Another example is the Sony Model RMT-193 remote commander assembly for controlling VCR and TV systems. In this arrangement the remote controller has a matrix comprising a number of buttons, together with a split ring rotary dial system used as a "jog/shuttle" control in one mode, since the different parts can be used either to change the speed of scanning in a continuously variable fashion in either direction, or frames can be advanced one at a time. In the other mode of operation, the control can be used to scan through channels or scan through time settings in order to program the unit to function in accordance with a particular schedule. A third unit, the control for a CD player manufactured by Technics, uses a rotary dial to control the selection of tracks, perform queuing operations and shift the reproducing mechanism to different parts of tracks. These systems are too limited and specialized to be adaptable to the much greater and unique demands of a modern serial character printer, but they do establish standards for ease of use and simplicity of operation.

SUMMARY OF THE INVENTION

A control and display system for dot matrix printers in accordance with the invention, utilizes an internal microprocessor, a memory which is down loaded with programs from replaceable software cards, and a control panel incorporating a number of control buttons, an aligned display, and rotary dial system whose position is fed to the microprocessor. The arrangement is such that programs and data can be entered into the memory to be serially accessed and displayed under control of the rotary dial or control buttons so that parameters may be selected directly or by scrolling, and options within the parameters may be selected in the same way. The rotary dial can be turned for scrolling through the setup memory, or control buttons relating to the most used functions may be operated repeatedly. The software cards provide not only different printing functions but operation controls as well, to permit thousands of options to be made available. Moreover, the same controls govern mechanical functions, specifically vertical paper position and printhead position and limits of motion.

In a more specific example of a system in accordance with the invention, the control system provides a "setup menu" which leads the user through an appropriate sequence, enabling the user to make selections with reference to nothing else than the display. As each function is presented, the operator can scroll through the different possibilities, using the buttons to make the necessary selection for that possibility. To increase the range of possibilities, as in type fonts and languages, the separate software cards download programs into the random access memory. A non-volatile memory contains sufficient program information for bootstrap operations, and includes an operations section in which "default" or startup parameter settings can be retained for a number of different users.

BRIEF DESCRIPTION OF THE DRAWINGS

A better understanding of the invention may be had by reference to the following description, taken in conjunction with the accompanying drawings, in which:

FIG. 3 is an example of a complete set of menu that may be utilized in connection with the system of FIGS. 1 and 2.

DETAILED DESCRIPTION OF THE INVENTION

Figure 1:
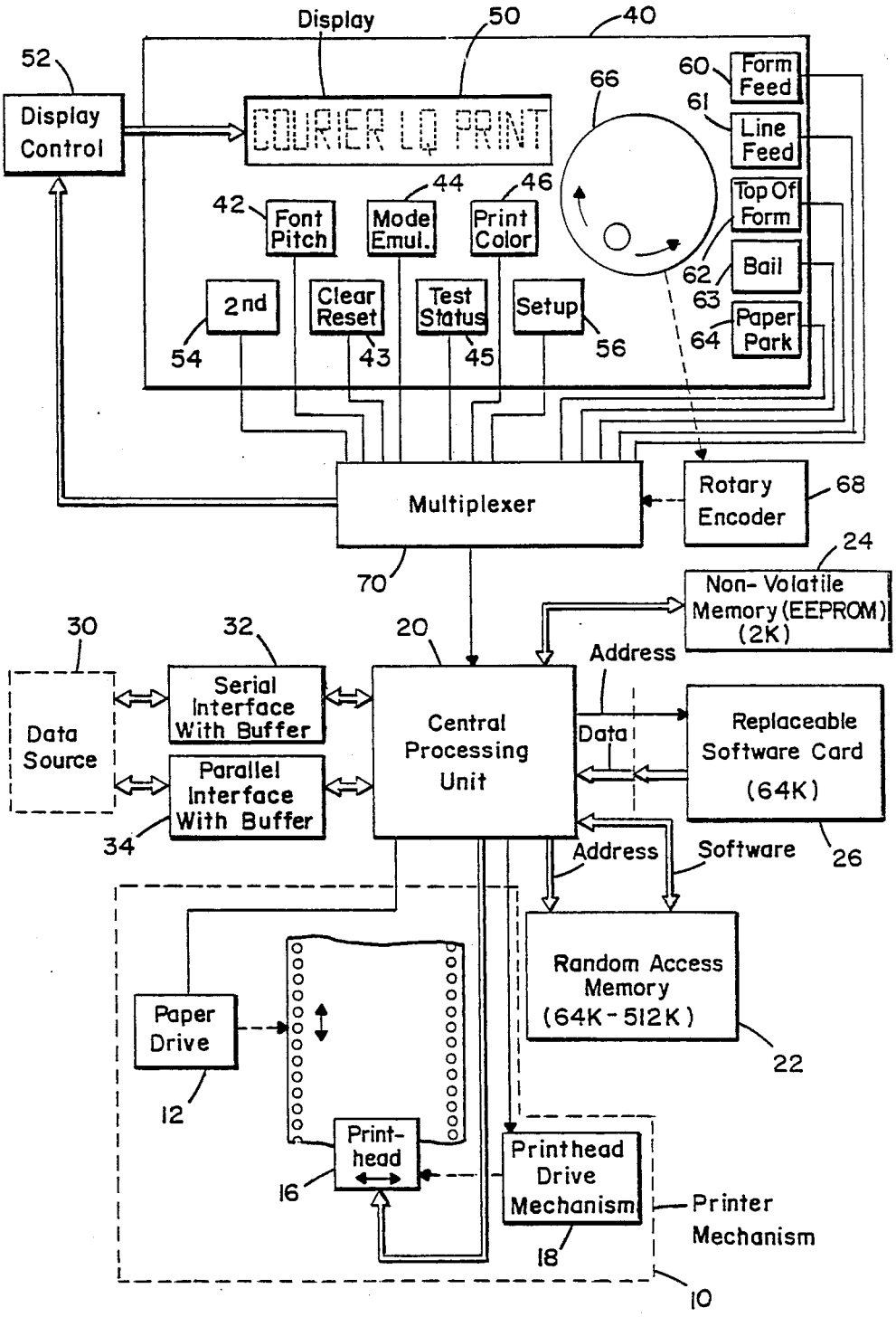
FIG. 1 is a block diagram of the principal elements of a line printer panel and control system in accordance with the invention.

Panel and control systems in accordance with the invention are advantageously utilized for the same applications as modern serial character printers of the type sold by Advanced Matrix Technology, Inc. under the designation AMT Office Printer. These printers have an internal microprocessor for operating a number of mechanisms and in a number of different modes in response to control selections. They include 18 or 24 wire printheads, and can operate from a very high resolution character cell (e.g. 72 h×32 v dots) in a high resolution mode which operates from 45–80 characters per second, depending upon character size, to a low resolution but high speed mode operating at 250–500 cps. The system also incorporates means for handling different specialized fonts and languages, emulating other printers, communicating with different systems, providing a wide range of typography, including the capability for adjusting character cell size, slant, spacing and height, and can print in a number of different colors with an appropriately segmented ribbon. Thus the printer mechanism 10 is not described in any substantial detail in the interests of simplicity and brevity. For present purposes, therefore, it need only be understood that the central processing unit 20 controls a paper drive 12 which advances the paper 14, here shown as pin feed paper, although cut sheet may alternatively be employed. The tractor/friction feed system, paper sensor, bail, platen, and other details for handling paper have consequently been omitted. The serial character printhead 16 is coupled to a printhead drive mechanism 18 and moved along a guideway system laterally relative to the paper 14, so as to print in unidirectional or bidirectional operation, the details of this arrangement also being omitted for simplicity.

In the central processing unit 20, resident software or firmware is used in known fashion, and in a manner consistent with the AMT Office Printer, to provide bootstrap operations, data transfer, and overall control functions. Within the central processing unit 20 a few of the principal functions have been separately identified in relation to different associated subsystems, in order to make more clear how certain functions are performed, but this is merely for illustration. The arrangement of the central processing unit 20 relative to the manner in which software is stored and utilized in this printer system are, however, unique. All operational programs, parameters and options are ultimately entered into a random access memory (RAM) 22 of large capacity (64K to 512K), the memory capacity depending both upon the number of alternatives desired to be kept available and the number of control functions to be performed. Random access memory 22 is a volatile memory, and is initially empty at the start of power-on operations. Bootstrap operations and a chosen set of power-on "default" settings are held in a non-volatile but changeable memory (EEPROM) 24, having a 2K capacity. All of the remainder of the operative software is contained in a replaceable software card 26, having a 64K capacity, although larger cards or cartridges may also be used. The replaceable software card 26 plugs into a receptacle 28, shown only symbolically, to provide parameters and options for a number of modes, including operations, print, page setup, tabs, communications and special modes. The card also contains execution instructions for carrying out the details of the display, selection and control sequence. The contents of both memories 24, 26 are entered by the central data processing unit 20 into the random access memory 22 upon startup. Additionally, a data source 30, which can be at the same location or remotely spaced from the printer, can be used to down load software into the random access memory 22, if it is desired to use this source for supplying specialized fonts, languages, print characteristics or other features. The data source 30, which may be an associated data processing unit, a modem, or a storage system, is interconnected with the central processing unit 20 by a serial interface 32 or a parallel interface 34, each of which includes a buffer for suitable on-line or off-line control of the printer.

With this system and software arrangement, the printer operator utilizes a control panel 40 having a matrix of dual function pushbuttons 42, 43, 44, 45 and 46, each being substantially aligned with a different region of a single line character display 50, here a 16-character LCD display operated by a display control 52 which receives parallel signals from the central processing unit 20. Conveniently the messages for display, comprising a number of segments each having separate meaning, are generated in serial form and then converted to parallel by conventional means (not shown). The displayed message of "Courier LQ Print" designates that the print font is of "Courier" type, that the mode is the relatively lowest speed, letter quality (LQ) mode, and that printing is enabled (by the word "Print"). Each of the buttons 42–46 has a dual function, these functions corresponding to parameters or operations which are most commonly used in the operation of the system. The two functions for each button are distinguished by the use of an additional button 54, which is an alternate or "second" button and which, when pressed concurrently with one of the primary buttons 42–46 changes the applicability to the alternate significance. The first button 42 is devoted to "font" and "pitch", the third button 44 is devoted to "mode" or "quality mode", and to emulation, and the third of the group 46 is devoted to the "print enabling" or terminating function, and to the color selection. When used individually or in conjunction with the "second" button 54, these buttons provide direct access to the given parameters in a fashion described in greater detail below. An additional control button at one side, labeled the "setup" button 56, is used to initiate operations on the display. At the right-hand side of the control panel 40, as seen in FIG. 1, there are a series of paper handling control buttons, designated: the form feed button 60, the line feed button 61, the top of form button 62, the bail button 63, and the paper park button 64. A rotary dial 66 on the control panel 40 may be rotated in either direction, and controls a rotary encoder 68 which may be of any conventional form that generates one or two signals from which increments of rotation and direction of rotation may be determined. The two additional buttons in the primary control set are a clear and reset button 43 and a test and status button 45 which do not control or relate to specific parameters in the system but which initiate particular operations as described in more detail hereafter. Again, the alternate settings of these two buttons 43, 44 are chosen by concurrent operation of the "second" button 54.

Signals for the display control 52 from the central processing unit 20 are coupled into a multiplexer 70, synchronized with the central processing unit 20. The fixed control buttons 42–46, 54, 56, and 60–64, are all coupled individually to the multiplexer, as is the rotary encoder 68. The central processing unit 20 is arranged with three interrupt timer sequences constantly repeated, which provide display signals to the display control 52 in one phase, test the button switches in a second phase in successive scanning fashion, and read the position of the rotary dial 66 in the third phase. Thus all of the elements on the display panel 40 are either energized for display or monitored on a real time basis sufficiently rapidly so that no data is lost. Additionally, the central processing unit enables the switches when they are to be operated.

The system is also characterized by the fact that no manual control is to be utilized other than for entering paper into the machine. There need not be a paper advance, for example, or manual control of the bail, although a lever (not shown) may be employed to switch between friction feed for cut sheet paper and tractor feed for pin paper. All movements of the paper 14 and the printhead 16, therefore, are effected by the operator under computer control, and the central processing unit 20 can therefore monitor the changes that are being made.

Hundreds, and thousands, of parameters, and options within the parameters, are made available through this arrangement and system. It will be seen by reference to FIG. 3 that there is an extensive setup menu of 48 parameters, and up to six options within each parameter, but this represents only programs which can be entered into the random access memory from one 64K card. Using two cards or more, or larger cards, or by downloading the programs from an external source, many more options and parameters can be made available if desired.

The setup menu is divided for convenience into six groupings which are not strictly in order of importance but which represent functions which are most often used, including, in the operations section, the revision or usage of previously established "default" settings, test operations, and the specification of the specifics of the print mode. The remaining groupings, involving page setup, tabs, communications and special modes, will generally be changed with decreasing frequency.

A brief description of the functioning of the system in providing display and operator control will be useful prior to a detailed discussion thereof. The system is capable of operating in which may be called a ƀfront panel" mode and a "menu" mode, the former involving direct selection and changing of functions, while the latter involves scrolling through the parameters, and through options within selected parameters covering all the adjustments and settings that may be needed.

The system operates in what may be called a front panel mode, in which the printer can be set up rapidly with only major adjustments. In this mode, the buttons 60–64 for controlling paper handling are operated to put the paper in as desired. The rotary dial 66 can be turned, in this mode, to move the paper in and out, so as to place it precisely it at the desired line. By pressing the "second" button 54 and operating the rotary dial 66 again, the printhead can be placed at a desired starting position. No settings are made at this time. The system can be subjected to diagnostic and other tests by actuating the "test" button 45. The same button 45 may be pressed along with the "second" button 54 to activate the "status" function, which provides a printout of the status of all parameters. The operator may change the font directly, in this front panel mode, simply by pressing the font button 42 until a preferred alternative appears. The printing mode can be changed, by actuation of the button 44, which alternatively is used to select which printer model the present printer is intended to emulate in responding to requests. It can emulate dot matrix printers, as well as daisywheel printers, in responding to signals. Again, the various options available for each of these directly available parameters, including also the color alternative on the remaining button 46, depressed along with the "second" button 54, can be cycled through the different options, to choose a selected state. Visual association of the different segments on the display 50 with the principal buttons 42, 44 and 46 used for parameter selection and option variations within the parameters provides the operator a compact view of the principal factors with which he is concerned.

To enter the menu mode, the operator presses the setup button 56, which begins the display of the parameters in the sequence shown in FIG. 3, in this example. In the menu mode, the rotary dial 66 and "second" button 54 are the primary means of control. If the parameters and the options within them are viewed as a matrix, the central processing unit 20 repeatedly goes to the random access memory 22 to pull out first the principal parameters, in succession until a chosen parameter is presented, by rotating the dial 66 to scroll through the different possibilities. Each different parameter is accompanied by its number on the display 50 so that the sequence can readily be monitored by the operator. When the given parameter is reached, the options within the parameter are scanned by pressing the "second" button 54 as the rotary dial 66 is turned. When the desired option appears on display 50 the "second" button 54 is released and the setting that is displayed becomes the current setting. However, the system uses the "default" settings whenever it is started, and maintains these until such time as they are changed by the operator. Thus changes need not be introduced except for those factors which the operator wishes to change. With reference to FIG. 3 each of the selectable parameters listed in the setup menu summary are described in more detail below.

Setup Menu Summary

Menu Parameter (1) RSTOR:
Function
Restores printer settings to fixed preset settings or to that which was previously saved using the SAVE parameter. Selecting RSTOR the printer clears the data input buffer.
Options
Selecting None cancels function; Fctry to restore printer to fixed preset settings; or USRl through USR5 to restore printer to the setting priorly saved under 1-5 preset setting selections.
(2) SAVE:
Function
Saves the current printer settings in a non-volatile memory for use at a subsequent time.
Options
Selecting None cancels function; the current printer settings may be saved under one of the USR1–USR5 parameters.
(3) DFALT:
Function
Selects the printer settings to use as the power-on default settings. The power-on default settings may either be the fixed preset setting or the settings saved previously with a SAVE operation. The DFALT selection is maintained in a non-volatile memory so as to be retained when the printer power is turned off.
Options
Selecting Fctry introduces the fixed preset settings as the power-on default or USR1–USR5 to introduce the settings saved under one of these parameters.
(4) TEST:
Function
Initiates a variety of printer tests including diagnostics, memory check, ribbon alignment and serial loopback.
Options
Selecting None negates the test; Diag initiates a full complement of printer diagnostics; Memory interrogates the printer memory; Ribbon initiates a ribbon alignment print test; Serial initiates a serial interface test.
(5) EM:
Function
Selects a printer emulation of other commercially available printers. By selecting an emulation, all printer settings remain intact but the printer clears the data input buffer.
Options
Emulation of AMT, Diab 630, Xer 4020, Epson JX/FX, Epson LQ, IBM XL24, IBM 5182.
(6) QUAL:
Function
Selects the quality of the printed text.
Options
Letter for letter-quality printing at 80 to 100 c.p.s.; Memo for memo-quality printing at 200 to 200 c.p.s.; or Draft for draft-quality printing at 400 to 500 c.p.s. It will be evident that an Executive quality print of even higher resolution and lower character rate can be supplied as another alternative.
(7) FONT:
Function
Selects a font or type-set style.
Options
Courier, LeGoth, Gothic, Elite (expandable to include additional fonts available from replaceable software card 26).
(8) PITCH:
Function
Selects the number of characters to print per inch.
Options
10, 12, 13.3, 15, 17.1, or 20 characters per inch or PS (proportional) spacing.
(9) CELL:
Function
Specifies how much to expand or compress characters so that they look appropriate when printed at the selected pitch.
Options
10, 12, 13.3, 15, 17.1, or 20, and PS (proportional spacing).
(10) LPI:
Function
Specifies how many lines to print per inch.
Options
3, 4, 6, 8 or 12 lines per inch.
(11) COLOR:
Function
Specifies a color for printing.
Options
Blue, Black, Red, Yellow, Purple, Green or Orange. With monochrome ribbon installed the setting remains black.
(12) ITALIC:
Function
Enables the specification of how many degrees the text should slant to the right.
Options
Off, 10°, 20° or 30°. In the Off mode the slant is dictated by the particular font setting.
(13) HIGH:
Function
Enables the double-high mode in which characters are stretched downward to twice their normal height.
Options
On or off.
(14) WIDE:
Function
Enables the double-wide mode for which characters are stretched rightward to twice their normal width.
Options
On or off.
(15) SCRIPT:
Function
Enables the superscript and subscript mode. In superscript, characters are shrunk to about half their normal size and print above the print line. In subscript, the same small characters print below the normal print line.
Options
Supr to enable the superscript mode, Sub to enable the subscript mode, or Off to disable both modes.
(16) UNDLINE:
Function
All characters and spaces are underlined.
Options
On or Off.
(17) BLD/SHA:
Functions
To enable and disable the bold and shadow modes. In the bold mode, characters are printed twice one upon the other to produce bold print. In the shadow mode characters are printed twice, once and then again slightly offset to the right to produce shadow print.
Options BLD enabling bold mode; SHA enabling shadow mode; Off to disable both modes.

(18) CTR/JST:

Functions

Enables the center and justify modes. In the center mode each line of text is centered between the left and right margins. In the justify mode the text is "justified" to the right margin.

Options

CTR to enable the Center mode; JST to enable the Justify mode; Off to disable both modes.

(19) LANG:

Function

Selects a language for the printer to use when printing text whereby selected standard ASCII printable characters are substituted by alternate characters that are used in a selected language.

Options

U.S.A., English, French, German, Italian, Spanish, Japanese, Swedish, Norwegian, Danish, Latin

(20) DIRCTN:

Function

Selects whether the printer should print in both directions.

Options

Bi-d for bidirectional printing or Uni for left to right printing.

(21) LENGTH:

Function

Selects the length of paper being used.

Options

A number from 0 to 255 is selectable which represents the multiple, 6 times the length of paper being used.

(22) WIDTH:

Function

Selects the maximum print width per line.

Options 8, 13.6 or 16 inches.

(23) DEMAND:

Function

Enables removal of a pin-feed page from the printer without affect to the subsequent page. Effective when printing serialized checks or forms where each page must be accounted for.

Options

On to enable the demand mode; Off to disable the demand mode.

(24) BIN:

Function

Selects the sheetfeeder bin to feed paper to the printer.

Options

Front to select the front paper bin; Back to select the back paper bin; Envel to select the envelope bin.

(25) TOP MAR:

Function

Selects the top margin.

Options

From 0 to 254 lines down from the top of the form:

(26) BOT MAR:

Function

Selects the bottom margin.

Options

Bottom margin set from 1 to 255 lines up from the bottom of the page.

(27) LFT MAR:

Function

Selects the left margin.

Options

Selectable from 0 to 271 character spaces to the right of the far left print position.

(28) RGT MAR:

Function

Selects the right margin.

Options

Selectable from 1 to 272 character spaces to the right of the far left print position.

(29) SET HOR:

Function

Selects a horizontal tab location.

Option

Tab location selectable from 0 to 272 character spaces from the far left print position.

(30) CLR HOR:

Function

Clears one or all horizontal tabs set previously with the SET HOR parameter.

Options

All to clear all horizontal tabs; or a location from 0 to 272 to clear a specific tab at such location.

(31) SET VER:

Function

Selects a vertical tab location.

Options

Vertical tab location selectable from 0 to 255 lines down from the top of the sheet.

(32) CLR VER:

Function

Enables clearing one or all vertical tabs set previously with the SET VER parameter.

Options

All to clear all vertical tabs or from 0 to 255 to clear a tab at a corresponding line.

(33) INTRFCE:

Function

Selects either the parallel or serial interface port for communication with a host computer.

Options

PAR for parallel; SER for serial.

(34) BAUD:

Function

Selects the serial baud rate of the computer being used with the printer.

Options

Baud rates of 150, 300, 600, 1200, 2400, 4800, 9600, 19200 or 38400.

(35) PARITY:

Function

Selects the parity xethod being used by the computer.

Options

None for a computer without support parity; Odd if the computer uses odd parity; Even if the computer uses even parity.

(36) DTA BITS:

Function

Selects the number of data bits per byte supplied to the printer by the computer.

Options 7 for 7-bit bytes; 8 for 8-bit bytes; 8M for 8-bit bytes and the printer is to ignore the most significant bit.

(37) STOP BITS:

Function

Selects the number of stop bits the computer is sending in each byte.

Options 1 for a computer sending one stop bit; 2 if the computer sends two stop bits.

(38) HNDSHAK:

Function

Selects the handshaking method used by the computer. Handshaking is a technique that starts and stops data transmission between the computer and the printer.

Options

DTR for DTR hardware message; XON for the X-ON/X-OFF software method; ETX for the ETX/ACK software method; D/X for both the DTR and X-ON/X-OFF methods; D/E for both the DTR and ETX/ACK methods; None for no handshaking method.

(389) DTR:

Function

Selects the polarity of the extra Data Terminal Ready (DTR) signal in the printer's serial interface.

Options

Neg for a signal that goes low to enable data transmission; Pos for a signal that goes high to enable data transmission.

(40) STROBE:

Function Selects the polarity of the parallel STROBE signal used by the computer.

Options

Neg for a negative STROBE pulse; Pos for a positive STROBE pulse.

(41) BUSY+:

Function

Enables and disables the parallel BUSY signal.

Options

On to enable the BUSY signal; Off to disable the BUSY signal.

(42) ACK—:

Function

Enables and disables the parallel ACK signal.

Options

On to enable the ACK signal; Off to disable the ACK signal.

(43) HEX MOD:

Function

Enables or disables the hexadecimal mode. In this mode the printer prints the hexadecimal representation of every byte it receives.

Options

On to enable the hexadecimal mode; Off to disable the hexadecimal mode.

(44) DOWNLOAD:

Function

Selects the number of downloaded fonts the printer can receive.

Options

Number of fonts dependent upon printer memory.

(45) AUTO CR:

Function

Enables and disables the automatic carriage return mode.

Options

On to turn the automatic carriage return mode on; or Off to turn the mode off.

(46) AUTO LF:

Function

Enables and disables the automatic line feed mode.

Options

On to turn the automatic line feed mode on; or Off to turn the automatic line feed mode off.

(47) AUTO FF:

Function

Enables and disables the automatic form feed mode. In this mode the printer skips over the perforations of pin-feed paper by setting top and bottom margins to one-half inch.

Options

On to turn the automatic form feed mode on; Off to turn the automatic form feed mode off.

(48) IBM* SET:

Function

Selects the manner to print the IBM character set.

Options

#1 to enable the printing of the full 256-character set; select #2 to enable the printing of all characters except those assigned to ASCII codes 128, 135-143, 145-148, 152, 154 and 155.

*A trademark of the International Business Machines Corporation.

Figure 2A:
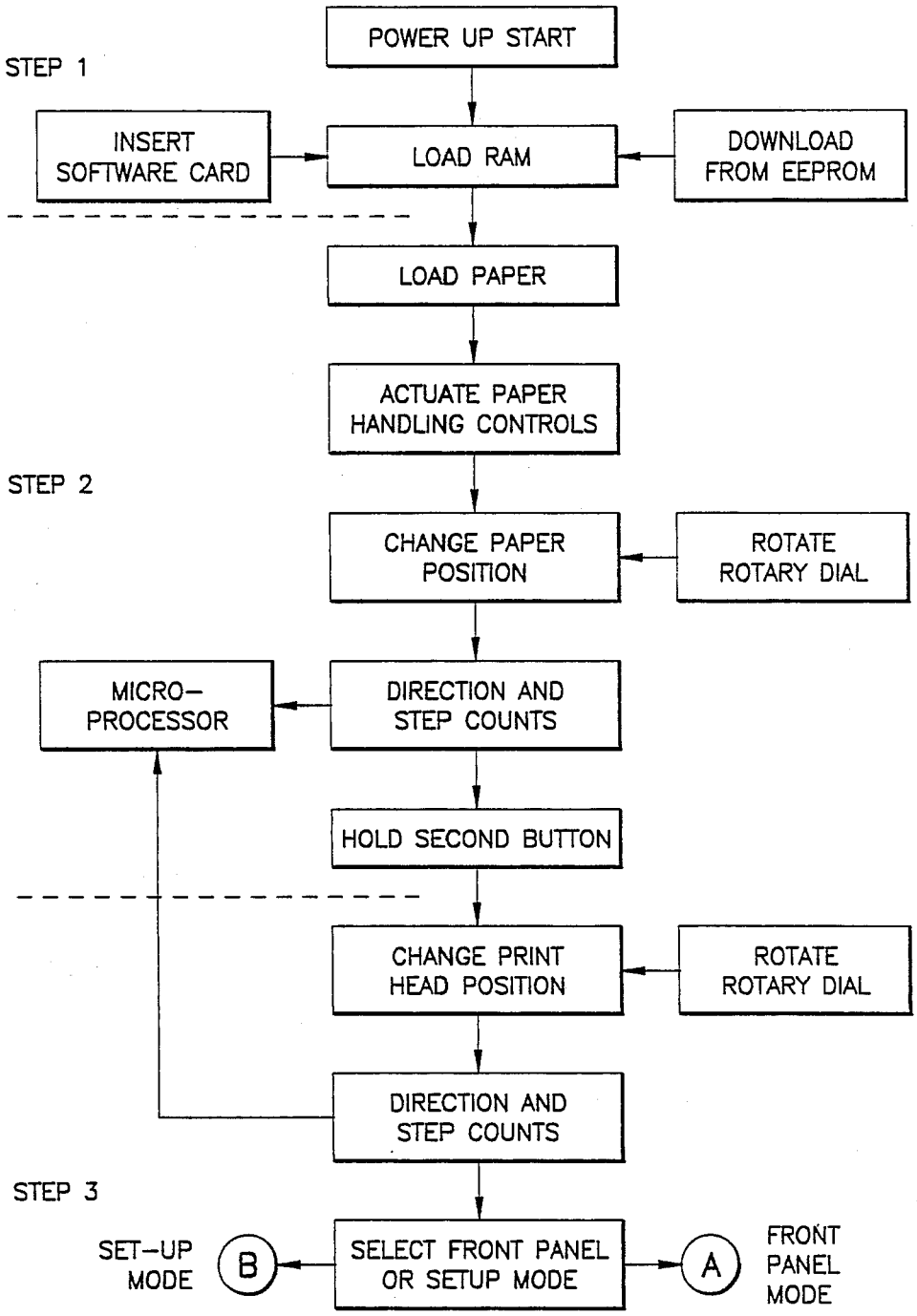
FIGS. 2A and 2B is a flow chart of typical sequences of operation utilized in operating a printer system employing the arrangement of FIG. 1.
Figure 2B:
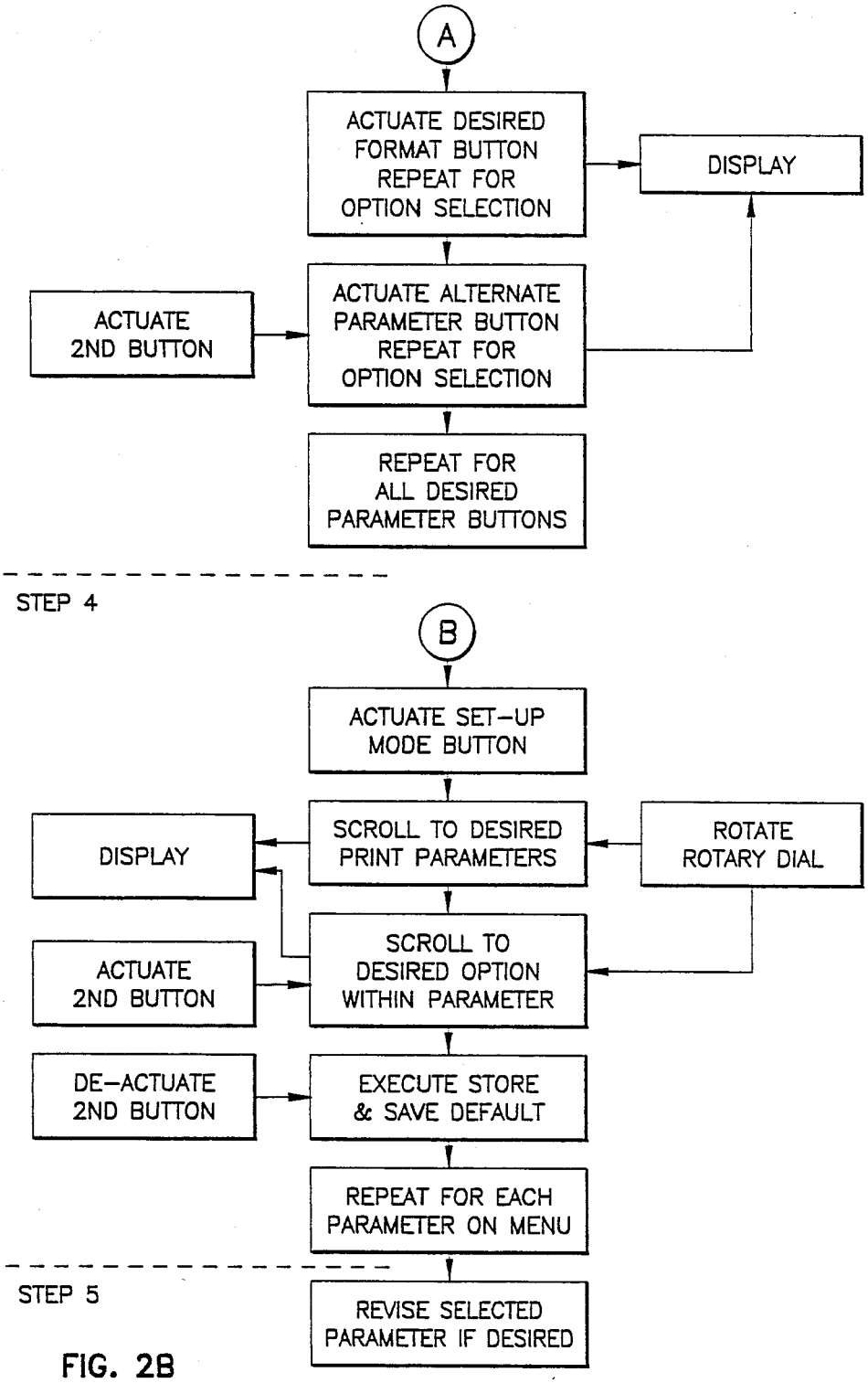

Referring now to FIGS. 2A and 2B, the sequence of operations in initializing the printer in preparation for receiving coded data from a computer to printing in a desired manner is presented below.

Step 1

Prior to a power-up/start command of a replaceable software card 26 is inserted into receptacle 8. The card 26 can contain printer/plotter emulations, fonts, diagnostic and other programs of the type desired by the operator. Upon power-up the program data contained in software card 26 and EEPROM 24 which contains bootstrap and default settings are loaded via central processing unit 20 to random aecess memory 22. Instructions and instruction addresses are stored for later access and retrieval by the central processing unit 20.

Step 2

The paper load sequence commences normally by the use of the form feed button 60 which advances a sheet of paper to the first printable line. Operation of the paper handling controls 61, 62, 63 and 69 is undertaken to orient the paper in accordance with the operator's requirements. The function of the paper handling controls such as line feed 61 and top of form 62 are self-evident and therefore do not require further explanation. Rotary dial 66 is then rotated in a direction to move the paper to a desired location. Position information is fed to the central processing unit 20 by direction and step counts to enable exact location of succeeding paper sheets used in continuous feed operations.

Step 3

The print head location sequence includes the use of the "second" button 54 and the rotation of rotary dial 66 which causes the print head to move in accordance with dial rotation. While the print head is being moved to a desired location corresponding count steps are fed to the central processing unit 20 to account for the exact location of the print head in anticipation of margin setting.

With the print head position established several of the most commonly used printing parameters may be established by depressing the correspondingly identified button on the front panel. Successive depressions of the same button successively selects the next available option for such parameter. By depressing the "second" button 54 the alternately identified parameter on the selected button is accessed. Thus depressing button 42, for example, selects the next available FONT option while depressing button 42 with the "second" button 54 depressed, selects the next available PITCH option. The current value of the parameter and option is presented in display 50.

For cycling through each parameter on the set-up menu or for accessing parameters not available on the front panel, the procedures described in step 4 are undertaken.

Step 4

The next series of procedures identified as the menu mode initiated by pressing the setup button 56 establishes the printing format, computer/printer interface, and selected special operations. When the setup button 56 is pressed the display 50 serves as a one line window capable of displaying one at a time each of the setup menu parameters. Each displayed menu parameter include its reference number to identify the location of the parameter on the parameter list as well as the current setting for that parameter.

Accordingly, and with reference to FIGS. 2A and 2B in prior discussion regarding the menu parameters, upon depressing the setup button 56 the first operation, i.e., RSTOR, appears with its current setting in the display 50. Depressing the "second" button 54 enables scrolling through the options by rotating rotary dial 66. Releasing the "second" button 54 at a desired option enters that option as the current setting. The above procedure is repeated for each of the 48 parameters on the menu. When it is desired to save a series of different parameter options under a particular designation the menu is scrolled back to the save parameter, the "second" button 54 is depressed, and scrolling to the desired designation is undertaken. Releasing the "second" button 54 causes all of the parameters and related options to be stored in the non-volatile memory 24 under the selected designation.

Similarly the default parameter options can be reset to any selected group of options by scrolling back to the default parameter after proceeding through the setup menu option selection process and depressing the "second" button 54 while scrolling to the desired default designation. The selected options will then be stored upon release of the "second" button 54.

Thus at the completion of the menu mode all 48 menu parameters will have been selected. For example, the print format such as font, pitch and color will be set. The page format such as length, width, margins and tabs will be set. Finally, communication information necessary for computer interfacing and special mode operations will be set.

Step 5

If during or after completion of the procedures described in steps 1–4 above it is desired to update any parameter option, it is only necessary in scrolling back to the parameter to be changed to press the "second" button 54, scroll the desired option, and release the "second" button, whereupon the selected parameter option will now represent the current setting. Of course if the new option is to be "saved" or included in the "default" designations those operations must be repeated.

While various modifications and alternatives have been shown or suggested in the specification it will be appreciated that the invention is not limited thereto but encompasses all forms and variations in accordance with the appended claims.

What is claimed is:

1. A printer system providing a wide ranging menu of control functions while enabling simple control of most used control functions comprising the combination of:

control panel means including a number of individually operable control element means designated for parameter selection;

manually operable control means bidirectionally changeable in position, the manually operable control means permitting sequential access of each control function listed in the menu, means including memory means for accessibly storing the entire menu of control functions in the form of parameters, and options within the parameters; and function control means including microprocessor means coupled to the memory means and control panel means and responsive to actuation of the control element means and the manually operable control means for (1) selecting parameters and (2) selecting options within the parameters, said function control means including means for shifting functions in response to (1) repeated application of an individually operable control element means and (2) movement of the manually operable control means.

2. The system as set forth in claim 1 above, wherein the manually operable control means comprises a rotary dial and encoder means responsive to the position thereof, and wherein the system further includes display means coupled to the memory means for displaying the parameters and the options within the parameters.

3. The system as set forth in claim 2 above, wherein the system further comprises a printhead mechanism and a paper drive mechanism, and wherein the function control means includes means responsive to operation of the manually operable control means for selectively positioning the printhead mechanism and the paper drive mechanism.

4. The system as set forth in claim 3 above, wherein the memory means includes a section for storing different parameters, and options within the parameters, and a second section for storing selected parameter settings, including settings for the selected printhead mechanism and paper drive mechanism positions.

5. The system as set forth in claim 4 above, wherein the system further comprises removable memory card means containing parameter and option data, communication instructions, and execution instructions, receptacle means coupled to the microprocessor means for loading at least portions of the data and instructions into the memory means, and wherein the memory means prior to loading contains only bootstrap instructions for operation of the system.

6. The system as set forth in claim 5 above, wherein the microprocessor means controls the memory means to present parameters cyclically on the display means in response to actuation of the manually operable control means, and includes means responsive to the actuated elements of the control panel means for selectively and cyclically sequencing through the options available at each parameter until one is selected.

7. The system as set forth in claim 6 above, wherein the individual control element means directly select different ones of the parameters most commonly used, and wherein the rotary dial sequentially proceeds through the available parameters and options within the parameters.

8. The system as set forth in claim 7 above, wherein the individual control element means include an array of control buttons, and wherein the display means comprises a single line display having different sections in substantial alignment with different ones of the buttons, and wherein the message segments on the display generated by the microprocessor means are in alignment with the respective corresponding buttons.

9. The system as set forth in claim 8 above, wherein the memory means includes a number of default parameter setting sections accessible in successive fashion, for enabling different power on default conditions to be effective.

10. A control panel for a serial dot matrix character printer comprising:

a single line display having characters for displaying at least several parameters;

a number of control buttons, at least some of the control buttons being associated with an individual group of character positions on the display wherein the control buttons are arranged in two groups, one of which comprises matrix of buttons in alignment with the display and the other of which comprises a separate spaced apart group devoted substantially to paper control function, and wherein the panel further includes an alternate setting button and a setup button adjacent the matrix; and a bidirectional rotary dial for scrolling control, the rotary dial permitting sequential display of each parameter.

11. A system for selecting and setting a multiplicity of parameters for a printer system having mechanical and electronically controlled functions, comprising:

a microprocessor system including display means and dynamic random access memory means;

control panel means including an array of individually operable control elements and a rotary manual control;

means responsive to the position of the rotary manual control for providing position signals to the microprocessor system;

means coupled to the memory means for providing a plurality of different individual parameter categories and settings and optional variations therefor;

means including the rotary manual control and the microprocessor system for displaying parameter categories and settings sequentially on the display means;

means including the control elements and the microprocessor system for directly displaying parameters on the display means;

means for changing the settings of individual parameters in response to repeated actuation of individual control elements; and means for alternatively changing the settings in response to operation of both the control elements and rotary control.

12. The invention as set forth in claim 11 above, wherein the system further includes means for changing the positions of the system mechanical structures using the rotary :manual control, and means for entering selected operating positions of the mechanical structures in the memory means.

13. The invention as set forth in claim 12 above, wherein selected ones of the manually operable control elements directly select different ones of the most commonly used parameters and wherein the repeated actuation of such selected control element sequentially proceeds through the selection of the available options within such parameters in a first mode.

14. The invention as set forth in claim 13 above, wherein the microprocessor system controls the memory means for (1) presenting the parameters cyclically on the display means in response to rotation of the rotary manual control and (2) upon actuation of a selected one of the manually operable control elements for presenting the optional variations within the parameters cyclically on the display means in response to rotation of the rotary manual control in a second mode.

15. The invention as set forth in claim 14 above, wherein actuation of a selected one of the manually operable control elements transfers the system between the first mode and the second mode.

16. The system as set forth in claim 7 or claim 15 wherein the display means displays in respective segments the parameters and current option within the parameter.

* * * * *